United States Patent [19]

Stevenson, IV

[11] Patent Number: 5,014,637

[45] Date of Patent: May 14, 1991

[54] ROLLER REEFING SYSTEM FOR SAILS AND THE LIKE

[76] Inventor: William H. Stevenson, IV, Old Mill, 605 Talbot St., St. Michaels, Md. 21663

[21] Appl. No.: 192,820

[22] PCT Filed: Jul. 14, 1987

[86] PCT No: PCT/US87/01642

§ 371 Date: Feb. 29, 1988

§ 102(e) Date: Feb. 29, 1988

[87] PCT Pub. No: WO88/00554

PCT Pub. Date: Jan. 28, 1988

Related U.S. Application Data

[63] Continuation-in-part of Ser. No. 886,001, Jul. 16, 1986, abandoned.

[51] Int. Cl.[5] ..... B63H 9/08

[52] U.S. Cl. ..... 114/103; 114/106

[58] Field of Search ..... 114/104–107

[56] References Cited

U.S. PATENT DOCUMENTS

| | | | |
|---|---|---|---|
| 70,256 | 10/1867 | Peterson . | |
| 3,147,729 | 9/1964 | Barnard . | |
| 3,298,346 | 1/1967 | Cochran | 114/103 |
| 3,611,969 | 10/1971 | Hood . | |
| 4,196,687 | 4/1980 | Newick . | |
| 4,248,281 | 2/1981 | Hood . | |
| 4,526,122 | 7/1985 | Kluckhuhn . | |
| 4,573,424 | 3/1986 | Clausin . | |
| 4,748,926 | 6/1988 | Perini | 114/104 |

FOREIGN PATENT DOCUMENTS

| | | |
|---|---|---|
| 0183658 | 6/1986 | European Pat. Off. . |
| 3211641 | 10/1983 | Fed. Rep. of Germany. |

*Primary Examiner*—Sherman D. Basinger

*Attorney, Agent, or Firm*—Roylance, Abrams, Berdo & Goodman

[57] ABSTRACT

The invention proves for flattening a cambered flexible sheet, usually a marine sail, by rolling a supporting edge of the sheet, typically the luff of a sail, on a rotatable support member. Applied to a sail, the invention provides a bolt rope and tape which effectively attaches only an intermediate portion of the luff to a rotatable stay member. A flexible material is also provided and this surrounds the stay member and extends over at least those portions of the luff which are not effectively attached to the stay member by the bolt rope and tape. When the sail is being reefed, that portion of the sail, which the bolt rope is attached to, is first wrapped around the stay member to reef the sail progressively in a flattening fashion.

33 Claims, 6 Drawing Sheets

FIG. 11
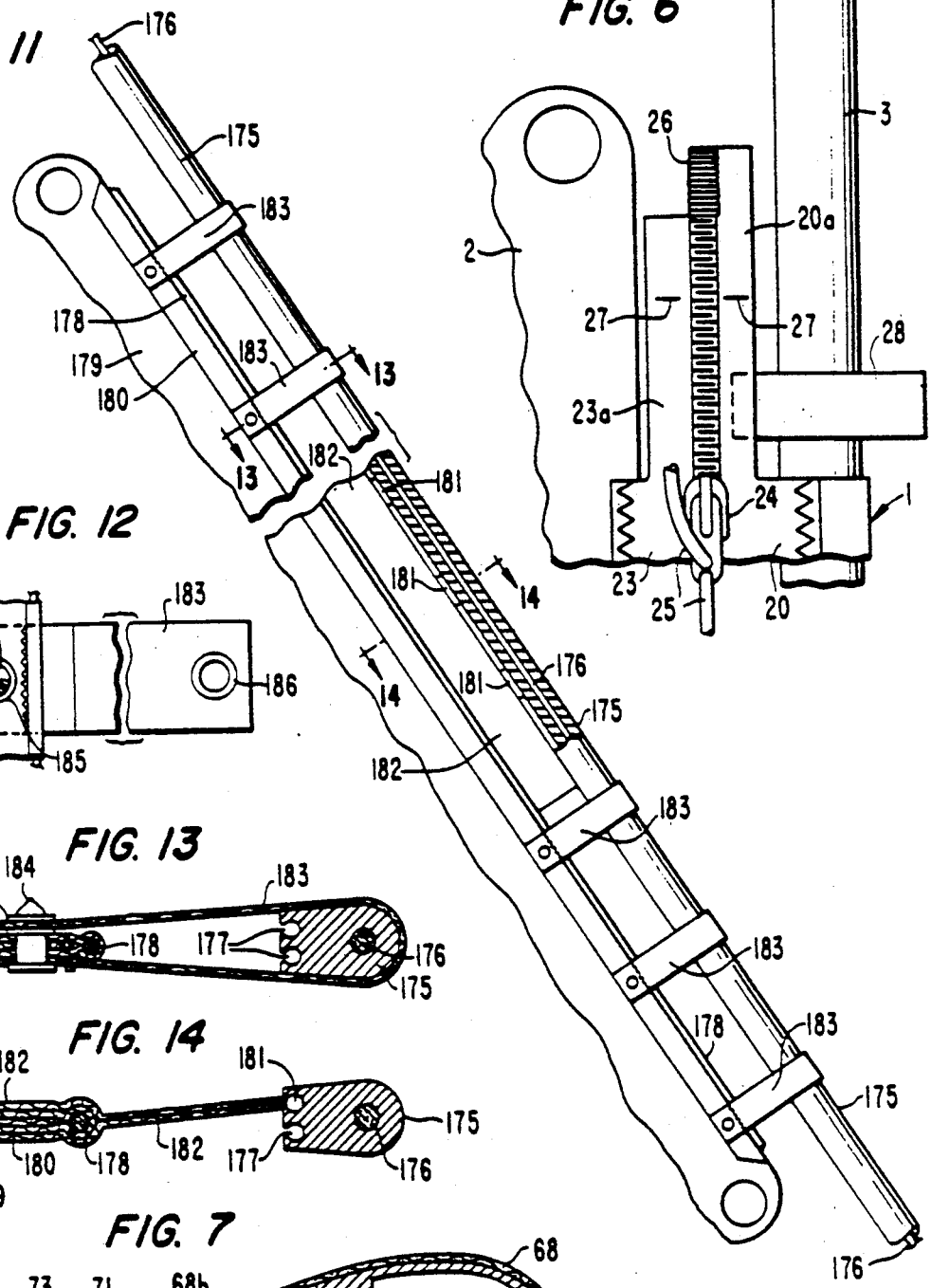
FIG. 6
FIG. 12
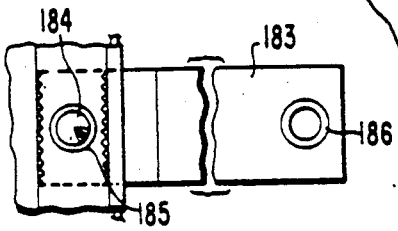
FIG. 13
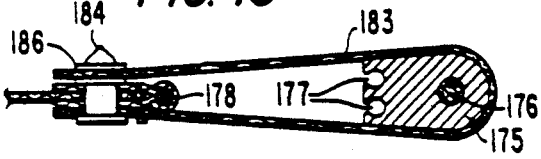
FIG. 14
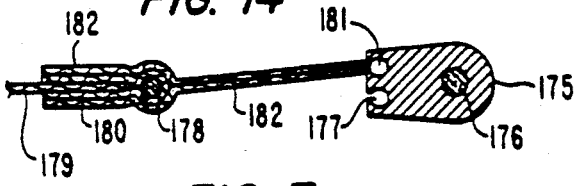
FIG. 7
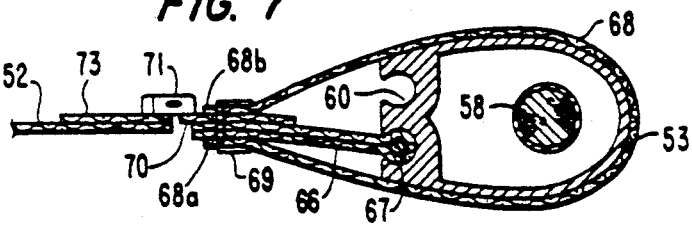

252
253
251
250
254
255
255
252
256
250
251
253

250
251
252
256
255
255

251
252
251
250
253
254

ROLLER REEFING SYSTEM FOR SAILS AND THE LIKE

RELATED APPLICATION

This application is a continuation in part of my application Ser. No. 886,001, filed July 16, 1986, now abandoned, the subject matter of which is incorporated herein by reference.

This invention relates to systems for supporting and reefing bodies of flexible sheet material, especially marine sails, which are of such plan shape and so supported that, when unreefed and extended under tension, the sheet material has a cambered shape.

BACKGROUND OF THE INVENTION

Marine sails have long been of such plan shape and so supported that, when flying and held in tension by wind, the sail assumes a cambered shape, commonly referred to as draft. In the case of a foresail, the leading edge or luff of the sail is supported from an elongated stay and is slightly arcuate, curving from the foot forwardly to an intermediate portion of the stay and thence aft to the head, and is secured to the stay member which slants upwardly and aft from the bow of the boat. In some cases, the stay member does not turn, and the luff of the sail is attached to the stay member by fasteners called snap hooks and, in such cases, reefing the sail to flatten it is difficult, especially when the sail is to be flattened as a result of reefing. In other cases, as in the now conventional roller furling systems, the stay member is made rotatable and use of the rotatable stay member has lead to roller reefing, the general state of the art being illustrated by the following U.S. Pat. Nos.:

| | |
|---|---|
| 70,256 | Peterson |
| 3,611,969 | Hood |
| 4,196,687 | Newick |
| 4,248,281 | Hood |
| 4,526,122 | Kluckhuhn |
| 4,573,424 | Clausin |

While roller reefing to flatten the sail has become a popular concept, prior-art systems have not achieved success from a practical standpoint in the trade. Though rolling the luff of the sail will reef the sail, such reefing has heretofore been accompanied by undue fullness, with the formation of wrinkles and pleats in the sail. Hood 4,248,281 discloses a very important objective, sought to be accomplished by attaching only an intermediate portion of the luff to the rotatable stay member and securing the tack and head in such fashion that initial turning of the stay member causes only the intermediate portion of the luff to be rolled, the sail therefore being flattened before being reefed, leading to what has been called "lag reefing" of the sail. But systems according to that patent have failed in actual practice to achieve the desired advantages. As a result, it has become common practice to secure to the luff of the sail a sheet of polymeric foam material, typically a sheet of closed cell elastomeric foam, the foam piece having a thickness of ⅛ in. to ¼ in. and being wider along an intermediate portion of the luff and tapering to narrow ends at the tack and the head. And this has become the practice even when the system of Hood 4,248,281 is employed. Though such use of added foam material provides improved roller reefing and flattening, use of the foam involves numerous disadvantages. First, as the luff is rolled, presence of the relatively thick foam material increases the roll diameter excessively, spoiling the air flow characteristics of the sail at the luff. Also, due to its excess weight, the foam material does not allow the sail to fill and draw properly in light air. With the foam sheet material secured to the sail by adhesive, there is a tendency for the foam material to become detached from the sail under the conditions of prolonged use of the sail. Further, over a period of use, the foam material tends to become compressed and crack and deteriorate. Finally, the foam material is unduly expensive. There has accordingly been a continuing demand for improvement in roller reefing.

SUMMARY OF THE INVENTION

According to the invention, the edge of the cambered flexible sheet to be rolled for flattening, usually the luff of a marine sail, is provided with a first securing means which extends along and is attached to only a predetermined intermediate portion of the edge to be rolled and which is employed to connect that edge portion to the stay or other rotatable member about which rolling is to occur. The same edge of the sheet is also provided with a second securing means comprising flexible means which is attached to the sheet and surrounds or embraces the rotatable member, over at least those portions of the rotatable member to which the first securing means is not connected, in such fashion that, before rolling of the flexible sheet on the rotatable member, and also during that early state of rolling when only the intermediate portion of the edge is rolled, the second securing means supports the edge of the sheet in proper relation to the rotatable member. Advantageously, the second securing means extends continuously along substantially the entire edge of the sheet to be rolled. The flexible means of the second securing means surrounds the rotatable member in such a fashion that, before the rotatable member is turned, the rotatable member is free to turn relative to the second securing means.

In the case of a genoa or other foresail to be reefed by rolling the luff, the first securing means can be a bolt rope sewn to the intermediate portion of the luff and adapted to be engaged within a retaining groove in the rotatable member, typically the grooved stay member of a roller furling system. The second securing means can be in the form of a single elongated piece of, e.g., sail fabric which has its two elongated edges secured to the luff of the sail, the width of the elongated piece being such that, once so secured, the resulting looped fabric can be slipped over the stay member and will then embrace the stay member sufficiently loosely to allow free turning of the stay member. Alternatively, one edge of the elongated piece of fabric can be secured directly to the luff of the sail while the other edge is secured to one tape of a conventional slide fastener, the other tape of the fastener being secured to the luff of the sail. As turning of the stay member commences, engagement of the first securing means, such as the bolt rope, with the stay member causes rolling of the intermediate portion of the luff on the stay member to commence. However, at this stage, all portions of the luff except the intermediate portion continue to be supported from the stay member only through the embracing action of the second securing means, the stay member being free to turn within the second securing means except where the intermediate portion of the luff is attached to the stay member. Continued turning of the stay member causes progressive rolling of the luff about the stay member and results first in further roller reefing and then, if desired, in roller furling of the sail. Since only the intermediate portion of the luff is rolled as turning of the stay member commences, the resulting reefing is truly progressive reefing, there being no rolling of the luff in its lower and upper portions. Unlike prior-art systems, roller reefing according to the invention truly flattens the sail, substantially without formation of pleats or wrinkles.

Rather than being a grooved roller furling stay member, the rotatable member can simply be a line, in which case the intermediate portion of the luff can simply be sewn to the line.

IDENTIFICATION OF THE DRAWINGS

FIG. 6 is an enlarged fragmentary elevational view of the head portion of the installation seen in FIG. 1;

FIG. 7 is a transverse cross-sectional view similar to FIG. 3 illustrating another embodiment of the invention;

Figure 15:
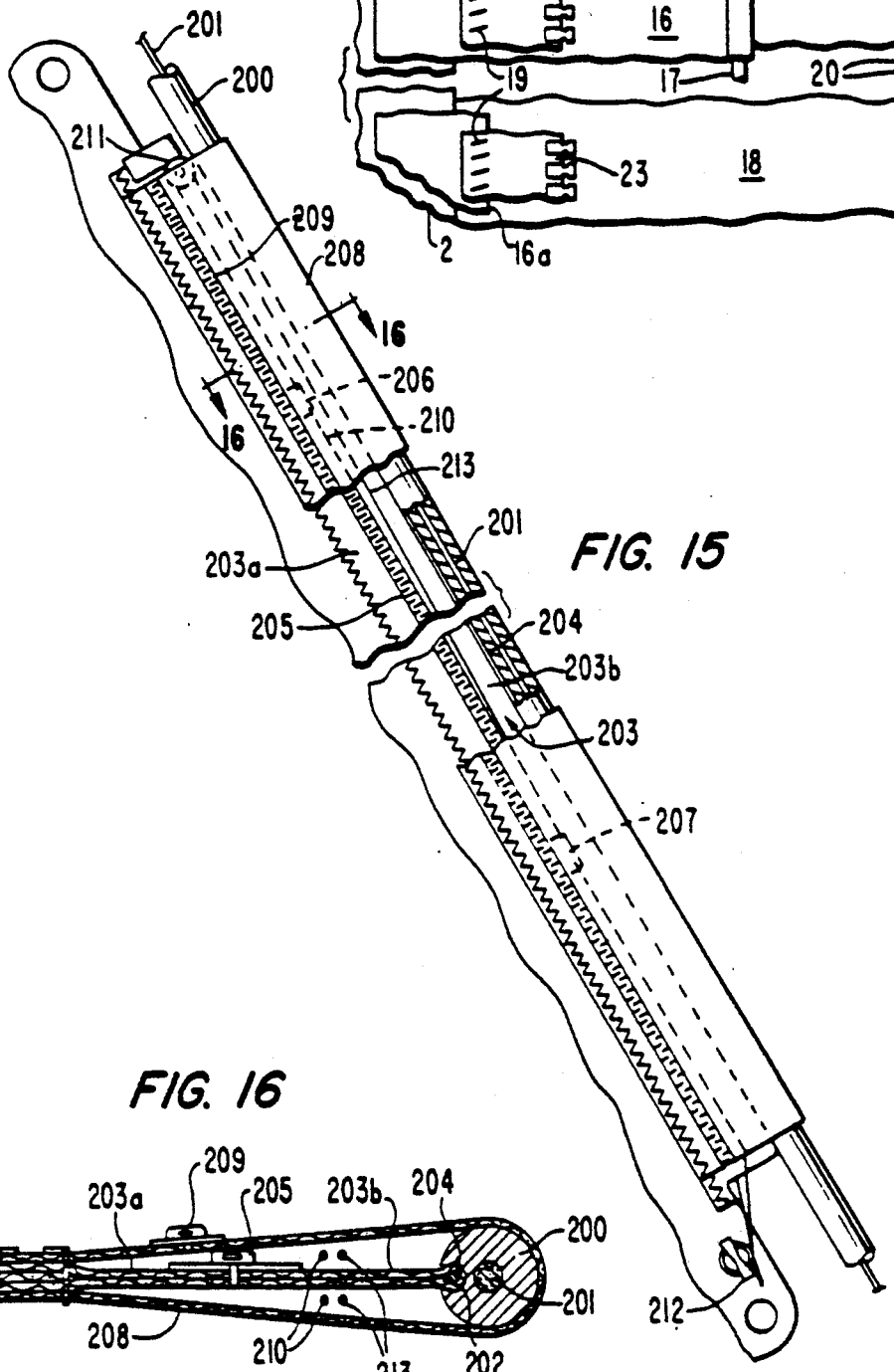
Figure 16:
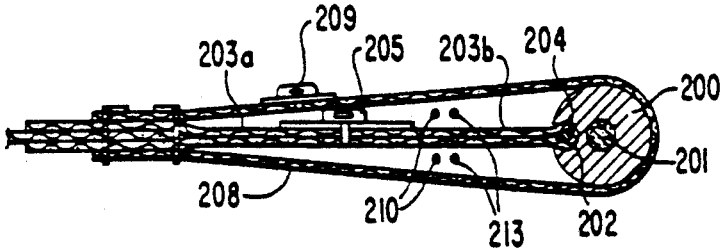
Figure 9:
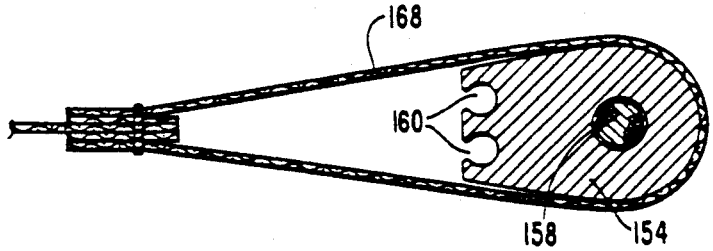
Figure 8:
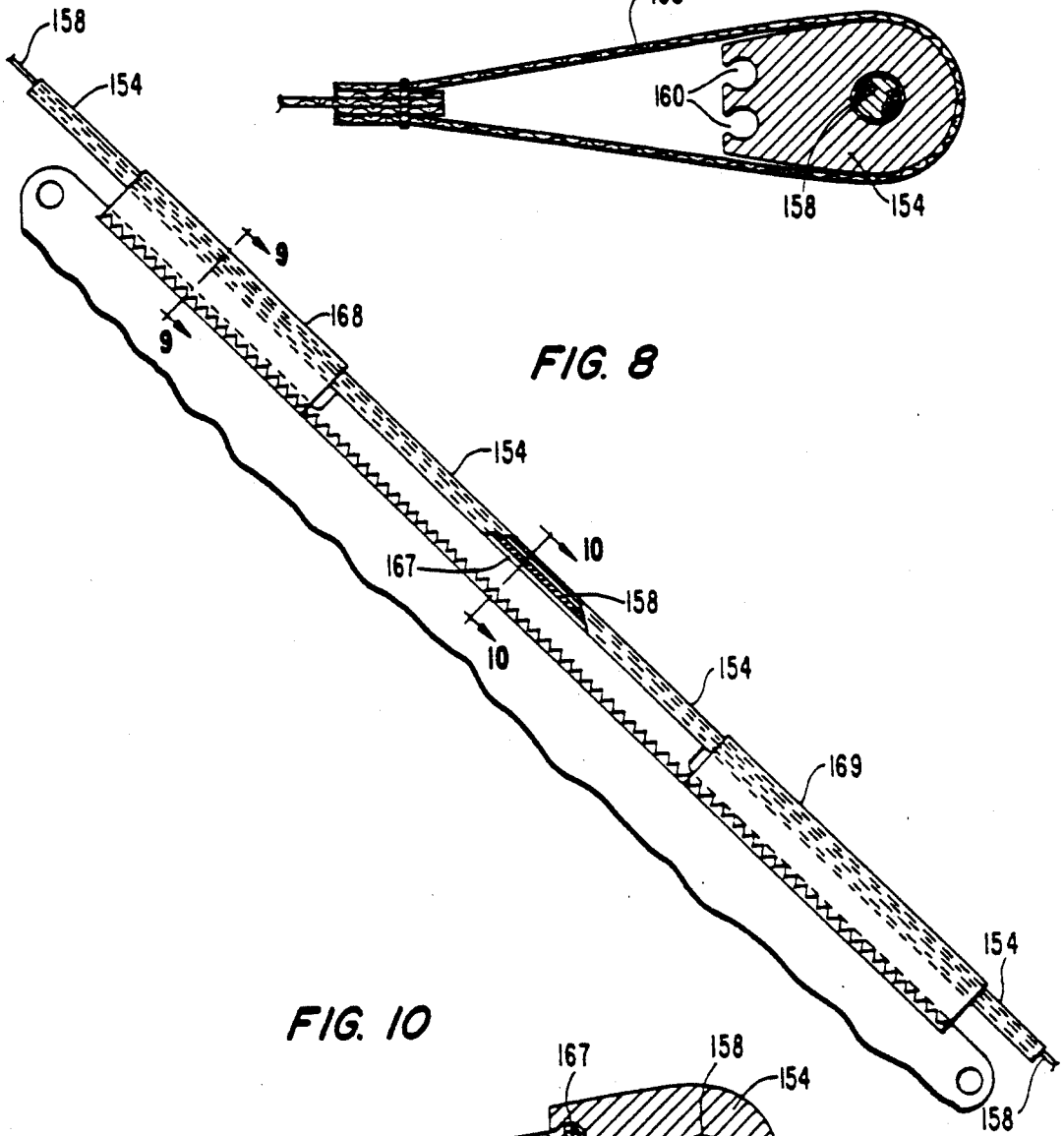
FIG. 8 is a fragmentary elevational view showing a modified form of the embodiment illustrated in FIGS. 1-6.
Figure 10:
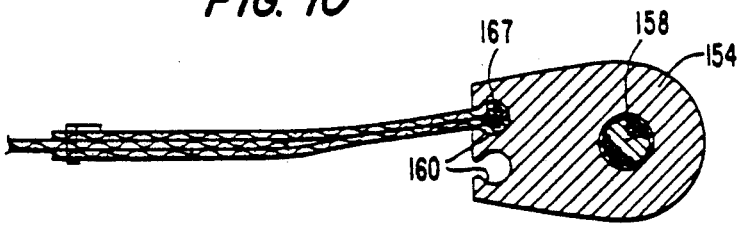
Figures 17, 18, 19:
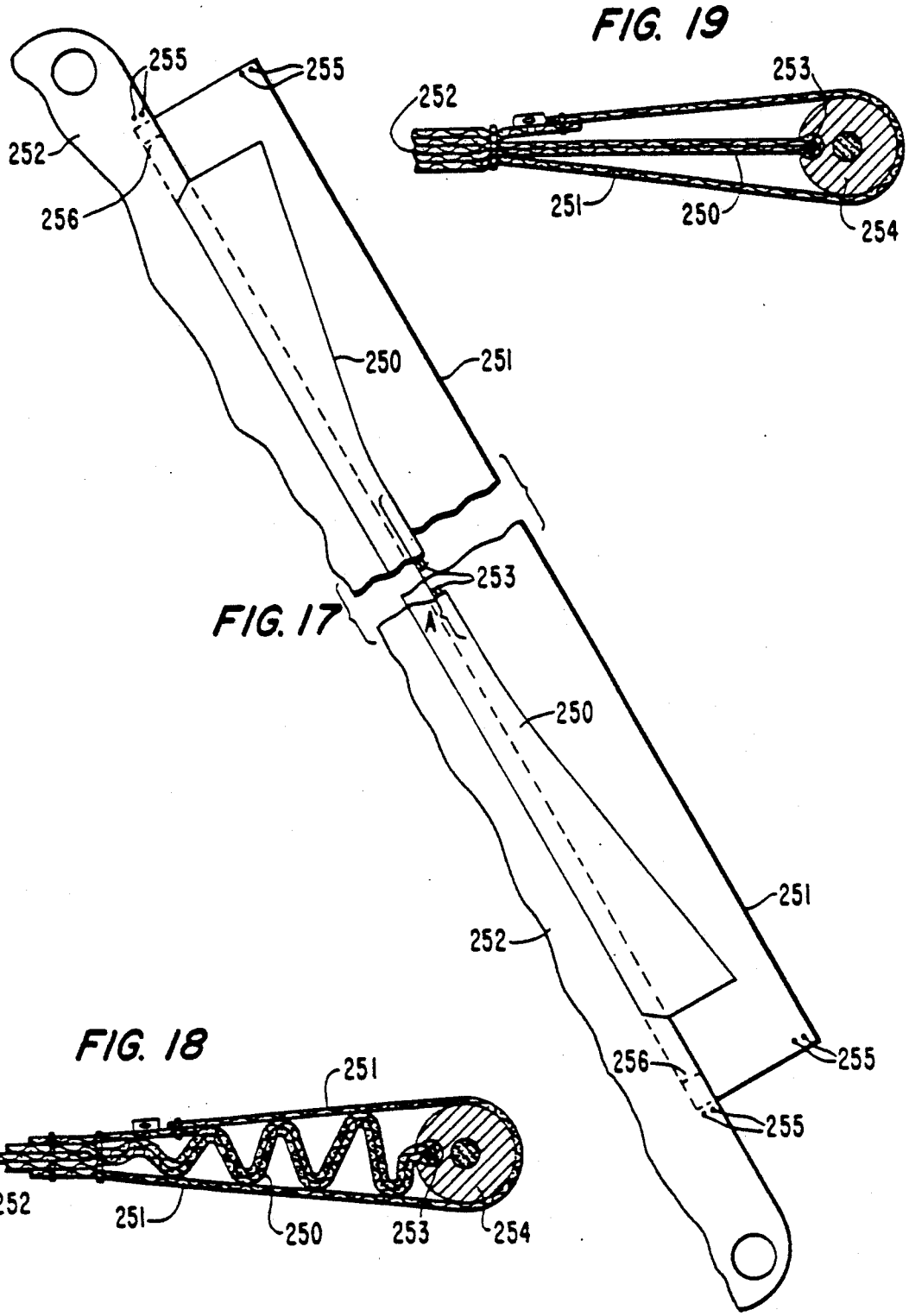

FIGS. 9 and 10 are transverse cross-sectional views taken generally on lines 9—9 and 10—10, FIG. 8, respectively;

FIG. 11 is an elevational view of a sail equipped with a roller reefing system according to another embodiment;

FIG. 12 is a fragmentary elevational view illustrating one of the tapes employed as the second securing means in the system shown in FIG. 11;

FIGS. 13 and 14 are transverse cross-sectional views taken generally on lines 13—13 and 14—14, FIG. 11, respectively;

FIG. 15 is an elevational view of a sail equipped with a roller reefing system according to yet another embodiment; and FIG. 16 is a transverse sectional view taken generally on line 16—16, FIG. 15;

FIG. 17 is a fragmentary plan elevational view of the luff portion of a genoa according to another embodiment of the invention before attachment to the rotatable stay;

FIG. 18 is a transverse sectional view similar to FIG. 16 but showing the manner in which the bolt rope and sleeve are associated with the rotatable stay at the upper and lower portions of the sail when the sail is flying; and FIG. 19 is a view similar to FIG. 18 but taken at an intermediate point along the luff.

DETAILED DESCRIPTION OF THE INVENTION

The Embodiment of FIGS. 1-6

Figure 2:
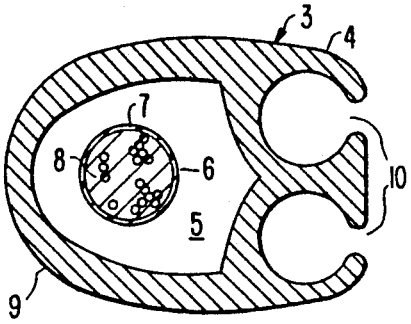
FIG. 2 is a transverse sectional view taken generally on line 2—2, FIG. 1, and enlarged to approximately twice actual size.
Figure 1:
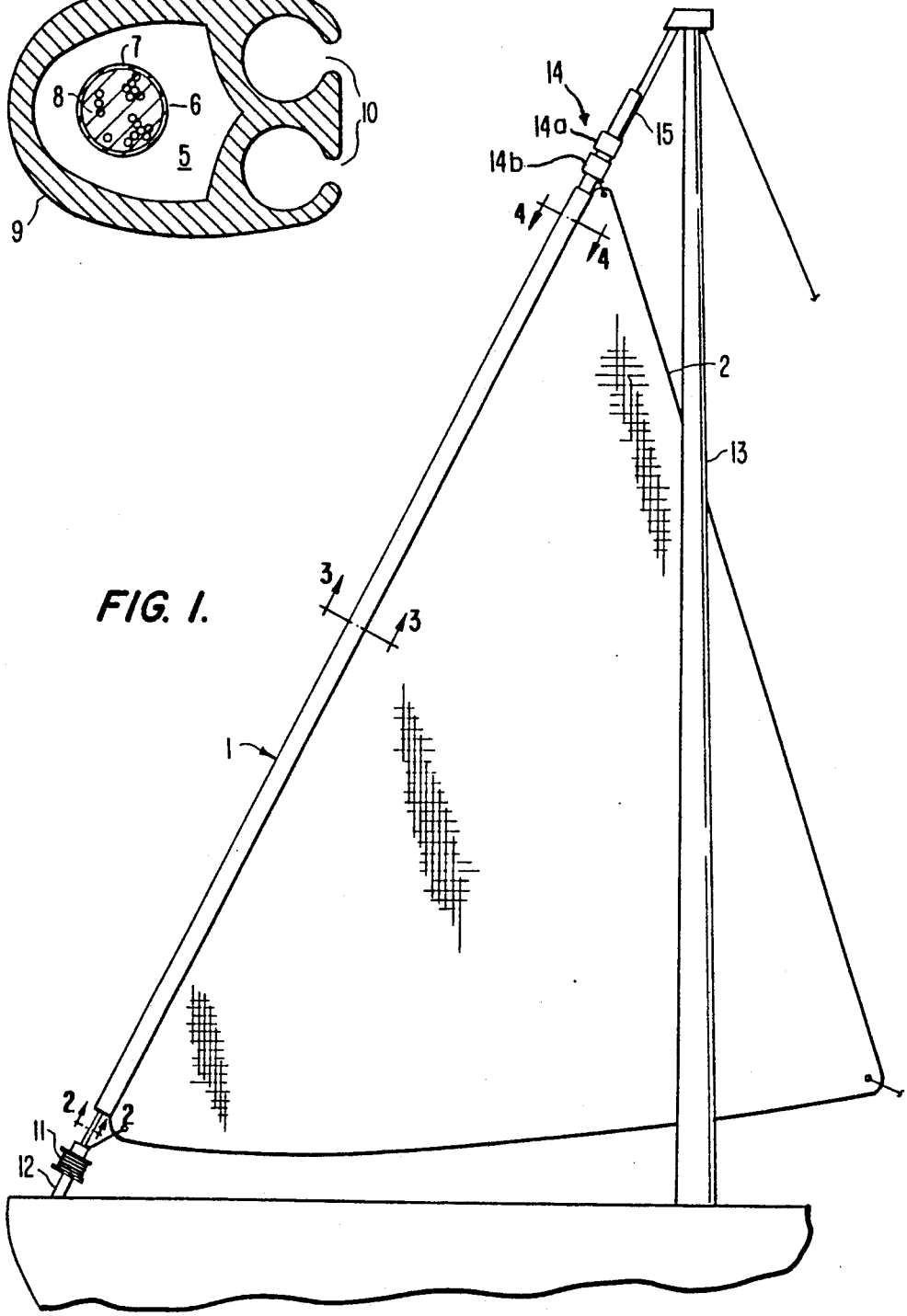
FIG. 1 is a semidiagrammatic elevational view of a roller reefing system according to one embodiment of the invention, installed to support and reef a foresail.

As shown in FIG. 1, roller reefing means 1 according to this embodiment is secured to the luff of a genoa 2 and supports the luff of the sail on the rotatable stay member 3 of a conventional roller furling system. Seen in more detail in FIG. 2, stay member 3 is made up of a plurality of sections 4 of aluminum extrusion secured end-to-end in conventional fashion by interfitting coupling sections 5. Each coupling section 5 has a through bore 6 which loosely embraces a low friction rigid polymeric tube 7 which in turn loosely embraces the conventional wire stay 8. Sections 4 are of identical cross-sectional shape and size, each having a rounded nose 9 and, at what may be considered the trailing edge of the stay, two parallel longitudinal grooves 10 which open away from the trailing edge of the stay. Wire stay 8 extends downwardly through the conventional roller furling drum and swivel assembly 11, the lower end of wire stay 8 being fixed to the bow of the boat, as by a conventional mounting member 12. The upper end of wire stay 8 is secured conventionally to the top of mast 13, with the wire stay in tension. Stay member 3 is freely rotatable on the wire stay but is secured to the drum of assembly 11, so that rotation of the drum rotates member 3, assembly 11 including a lower swivel to which the tack of the sail is connected, so that the tack does not turn with member 3. A conventional upper swivel 14 has an upper swivel member **14*a*, to which halyard 15 is connected and a lower swivel member 14*b*, to which the head of sail 2 is connected, stay member 3 being free to turn relative to both members 14*a* and 14*b***.

Figure 3:
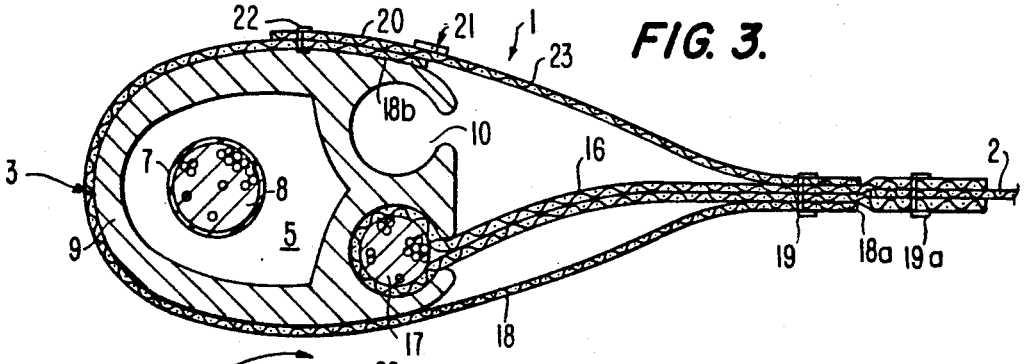
FIG. 3 is a transverse sectional view taken generally on line 3—3, FIG. 1, when the sail is flying under tension before rotation of the stay member to accomplish reefing has commenced.
Figure 4:
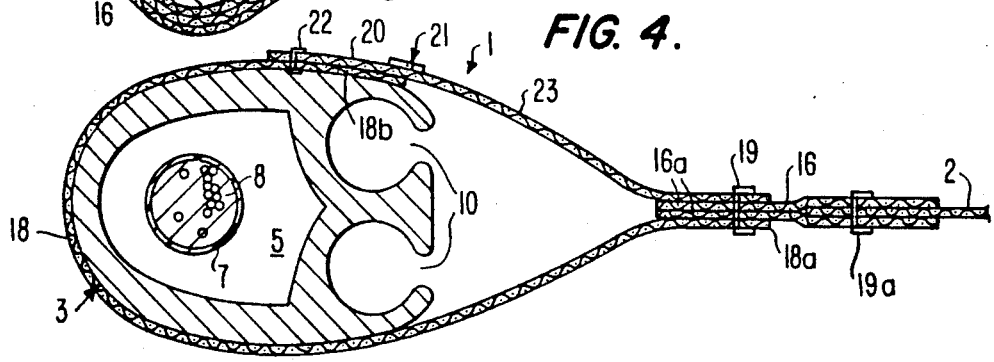
FIG. 4 is a transverse sectional view similar to FIG. 3 but taken generally on line 4—4, FIG. 1, again before turning of the stay member has commenced.
Figure 5:
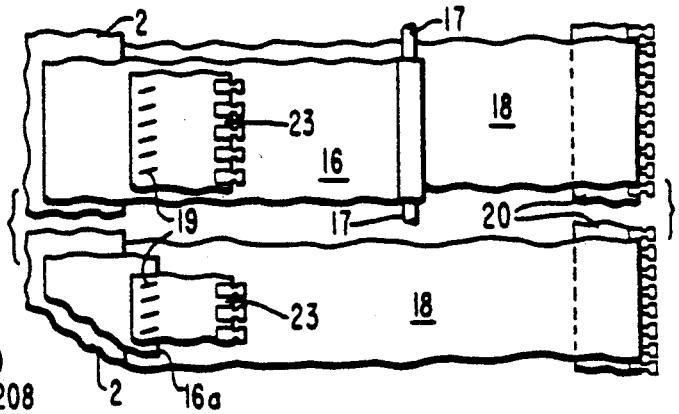
FIG. 5 is a fragmentary plan elevational view of the reefing system of FIGS. 1-4A before the second securing means has been closed about the stay member.

Turning to FIGS. 3-5, roller reefing means 1 comprises a length of bolt rope tape 16, the tape including two plies which embrace bolt rope 17, each ply extending rearwardly over a different side of the luff of sail 2 and being sewn and thus connected by stitching **19*a* thereto, the two plies also being stitched together at the bolt rope and immediately adjacent the luff edge of the sail via stitching 19. As will be clear from FIG. 5, bolt rope 17 extends along only an intermediate portion of the luff of the sail, the bolt rope tape being cut back so that portions 16*a* of both plies are sewn to the luff of the sail along those portions of the luff where the bolt rope is not present. Typically, the bolt rope extends along an intermediate portion of the luff which amounts to 30-70% of the total luff length, the precise length and location of the bolt rope depending upon the design details of the particular sail. The effective diameter of the bolt rope and the embracing portion of the tape is such that the bolt rope can be inserted endwise into one of the grooves 10 of rotatable stay member 3 and, when so inserted, will secure the corresponding portion of the sail luff directly to member 3. Thus, the bolt rope constitutes a first securing means for securing the sail to rotatable member 3**.

A second securing means embraces rotatable member 3 and is secured to the luff of sail 2 throughout substantially the entire length of the luff. In this embodiment, this second securing means comprises a first piece 18 of flexible material, typically sail cloth, which is long enough to extend for substantially the entire length of the luff, a first longitudinal edge 18*a* of piece 18 being stitched at 19 to the bolt rope tape immediately adjacent the luff edge of the sail. One tape 20 of a conventional slide fastener 21 extends along the second longitudinal edge 18*b* of piece 18 and is secured thereto by stitching at 22. The second tape 23 of slide fastener 21 overlies tape 16 on the side thereof opposite edge 18*a* of piece 18, tape 23 being secured to tape 16 by the stitching at 19. When the bolt rope has been inserted into one of the grooves 10 of rotatable stay member 3, as while the sail is being raised, slide fastener 21 can be closed, as by moving the slide or runner of the fastener from the head to the foot of the sail, and this can be accomplished from the cockpit by a remotely manipulated line (not shown). When fastener 21 has been closed, the combination of flexible piece 18 and fastener tape 23 are brought into the positions seen in FIG. 3 so that the second securing means embraces rotatable stay member 3. The combined widths of piece 18 and the tapes of slide fastener 21 are such that, when sail 2 is in tension so that piece 18 is pulled firmly against the rounded nose portions 9 of member 3, bolt rope tape 16 is just slightly in tension, support of the sail from member 3 being via the combination of piece 18 and the slide fastener tapes and the bolt rope tape. Further, while the tension on the sail holds piece 18 firmly against rounded nose portions 9 of member 3, the effective widths of piece 18 and the slide fastener tapes are markedly greater than the cross-sectional periphery of member, 3, so that, despite the fact that the sail is adequately supported by member 3, member 3 is still free to turn about its longitudinal axis relative to the second securing means.

Figure 3A:
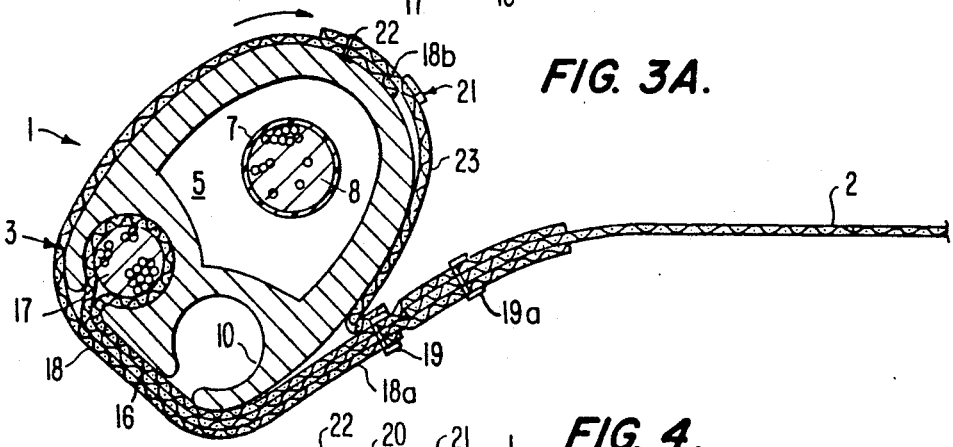
FIG. 3A is a transverse sectional view similar to FIG. 3 but showing the relationship of the components of the system after the stay member has been turned approximately 135° from the position seen in FIG. 3.
Figure 4A:
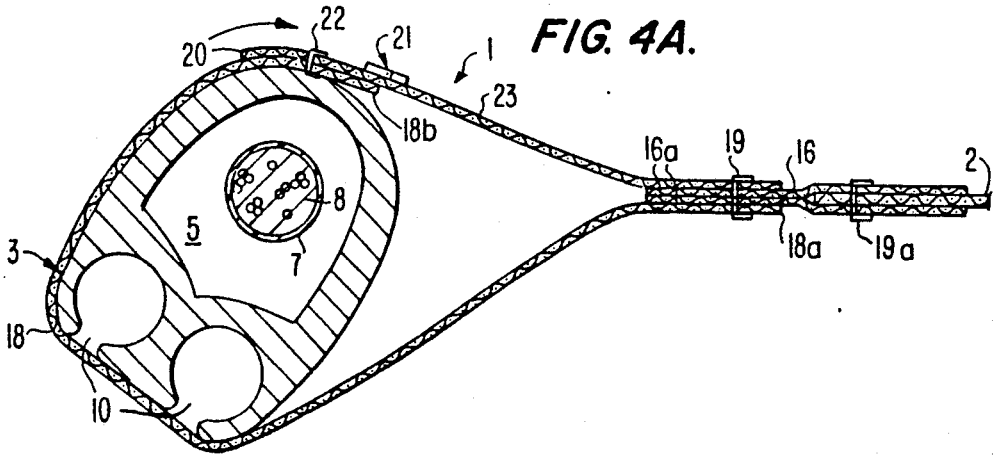
FIG. 4A is a transverse sectional view similar to FIG. 4 but showing the relationship of the components of the system after the stay member has been rotated approximately 135° from the position seen in FIG. 3.

When sail 2 is to be reefed, the furling drum of assembly 11 is turned in usual fashion, as by a line (not shown) extending to the cockpit, and stay member 3 is turned by the drum. As turning of the drum commences, the bolt rope tape and the portion of piece 18 which extends along the intermediate luff portion occupied by the bolt rope tape begin to wrap around stay member 3 in the manner illustrated in FIG. 3A, such early wrapping of only that portion of the luff to which bolt rope 17 is attached serving to reef sail 2 progressively in flattening fashion. At this stage, as will be clear from comparison of FIGS. 4 and 4A, essentially no reefing action occurs at the lower and upper portions of the sail where the bolt rope is not present, this being because stay member 3 is, at those locations, simply free to rotate within the second securing means formed by piece 18 and slide fastener 21. Significant further rotation of stay member 3 will cause sail 2, including its lower and upper portions, to wrap around the stay member, so that However, since both the tack and the head of the sail are connected to swivel members which do not turn with stay member 3, wrapping of the lower and upper portions of the luff on stay member 3 lags well behind the wrapping of the luff at the intermediate portion thereof, and true progressive reefing is thus achieved even though the combination of piece 18 and slide fastener 21, embracing the stay member substantially throughout the length of the luff, adequately supports the entire luff from the stay member throughout the reefing operation.

As shown in FIG. 6, the slide or runner 24 of fastener 21 is advantageously connected to the two ends of a line 25 which extends over sheaves (not shown) located respectively at the head and foot of the sail and which can be manipulated from the cockpit of the boat. This arrangement allows the sail to be raised while slide fastener 21 is open, the fastener than being closed throughout its length by manipulation of line 25. When the sail is to be lowered, the slide fastener can first be opened by manipulation of line 25. To assure that runner 24 remains properly engaged with the teeth of the slide fastener tapes when the runner has travelled to the upper end of its desired excursion, the slide fastener tapes continue beyond the upper end of piece 18 in the form of narrow portions 20*a* and 23*a* which are not attached to the sail or the rotatable stay member. Portion 20*a* projects beyond the end of portion 23*a* and is provided with heavy stitching along the edge aligned with the slide fastener to provide stop 26 for runner 24. Portions 20*a* and 23*a* are each provided with a reference mark 27 to assure proper alignment of the teeth of the two slide fastener tapes. A tape 28 has one end stitched to portion 20*a* so that tape 28 extends laterally from portion 20*a*. One face of tape 28 is of loop fabric, the other of hook fabric so that the two faces will adhere mechanically when in mutual contact as a VELCRO fastening in accordance with, e.g., U.S. Pat. No. 3,009,235 de Mestral. When runner 24 has been moved downwardly beyond the lower ends of portions 20*a* and 23*a*, tape 28 can be wrapped around portions 20*a* and 23*a* to assure that the upper end portion of fastener 21 remains closed. When the sail has been furled by being rolled about member 3, portions 20*a* and 23*a* and tape 28 are covered by the rolled head portion of the sail.

The Embodiment of FIG. 7

Though it is advantageous to have roller reefing means according to the invention permanently attached to the sail, this is not necessary in all cases. Thus, FIG. 7 illustrates an embodiment of the invention in which the roller reefing means is installed semi-permanently on the rotatable stay member, the sail is raised separately, and the sail is then secured to the roller reefing system.

Here, rotatable stay member 53, wire stay 58 and bolt rope tape 66 remain as described with reference to FIGS. 1–6. However, the second securing means comprises a single elongated piece 68 of sail cloth or the like, edges 68*a* and 68*b* of piece 68 overlying each other, with bolt rope tape 16 and tape 70 of slide fastener 71 lying between edges 68*a* and 68*b* and the combination being secured together by stitching 69. The second tape 73 of the slide fastener overlies and is stitched to the luff of the sail. Bolt rope 67 again extends for only an intermediate portion of the length of the sail, the plies of the bolt rope tape being trimmed back, as shown at 16*a*, FIG. 5, throughout those portions of the luff where the bolt rope is not present.

For installation, rotatable stay member 53 is detached from the rotating drum, flexible piece 68 is then slipped over the stay member, with bolt rope 67 being threaded into one of the grooves of the stay member, and the stay member is then reattached to the drum, Sail 52 is then raised conventionally and slide fastener 71 is operated to attach the luff of the sail to the roller reefing means. With sail 52 flying and under tension, the sleeve formed by piece 68 is held tightly against stay member 53 and is in tension, and bolt rope tape 66 is also under tension.

Reefing is carried out as described with reference to FIGS. 1–6.

The Embodiment of FIGS. 8–10

As seen in FIGS. 8–10, the second securing means can extend only along those portions of the sail luff not connected to the rotatable member by the first securing means. Here, the rotatable member is an elongated hollow aluminum extrusion 154 rotatably supported by stay 158 in the manner described with reference to FIGS. 1–6 and is provided with two longitudinal grooves 160 into one of which the bolt rope 167 is inserted to attach only an intermediate portion of the luff to rotatable member 154, the bolt rope tape being cut away except where the bolt rope is present. The second securing means is in the form of two sleeves 168 and 169 each sewn to the luff tape. Sleeve 168 extends over substantially the entire portion of the luff between the upper end of the bolt rope and the head of the sail. Sleeve 169 extends over substantially the entire portion of the luff between the lower end of the bolt rope and the foot of the sail. Sleeves 168 and 169 surround rotatable member 154 in the same fashion explained with reference to FIGS. 1–6 so as to support the upper and lower portions of the sail adequately, without malformation of the sail, when the sail is flying. During reefing by rotation of member 154, the two sleeves do not begin to wrap around the rotatable member until after that intermediate portion of the sail connected to member 154 by the bolt rope has wrapped sufficiently for reefing.

The Embodiment of FIGS. 11–14

FIGS. 11–14 show an embodiment of the invention which makes it particularly easy to lower and fold the sail. Rotatable stay member 175 and stay 176 are as hereinbefore described, member 175 having bolt rope-receiving grooves 177. In this embodiment, the sail is equipped with a primary bolt rope 178 which extends along substantially the entire length of the luff of sail 179 and is secured thereto by tape 180. The first securing means comprises a secondary bolt rope in the form of a plurality of relatively short portions or slugs 181 carried by bolt rope tape 182 and spaced apart lengthwise of the tape, tape 182 being cut back between the slugs so that only slugs 181 (and the portions of the tape embracing them) occupy groove 177 to secure the sail to the stay member. Slugs 181 are spaced along only the intermediate portion of the luff. The second securing means is in the form of a plurality of tabs 183 each having one end secured to the luff of the sail by male member 184 and locking collar 185 of a conventional snap fastener. The other end of each tab 183 is equipped with the female member 186 of the fastener. The snap fastener allows the tab to be stretched out, as in FIG. 12, then wrapped about the stay member and secured in looped form, as in FIG. 13.

As shown in FIGS. 12–14, tape 180 of the primary bolt rope overlies both surfaces of the luff of the sail in usual fashion, and tape 182 in turn overlies the tape of the primary bolt rope, the assembly being stitched together at the leading edge of the sail and at the trailing edge of the tapes. The tapes for the primary and secondary bolt ropes can thus be manufactured and supplied to the sailmaker in great lengths. Tabs 183 are simply stitched in place as the sail is made.

As the sail is raised, the looped tabs 183 on the upper portion of the sail are slipped over the rotatable stay member 175, the bolt rope slugs 181 are inserted successively into the same groove 177 of the stay member, and the ones of looped tabs 183 on the lower portion of the sail are then slipped over stay member 175 successively.

The Embodiment of FIGS. 15 and 16

FIGS. 15 and 16 illustrate reefing means which makes it possible to adjust the portion of the luff of the sail attached to the rotatable stay member by the first securing means. Here, rotatable stay member 200 is a rigid extrusion of circular transverse cross section and has a central axial through bore through which the stay 201 extends. Member 200 has a single longitudinally extending bolt rope groove 202. Bolt rope tape 203 extends for the full length of the luff of the sail and the bolt rope 204 is engaged throughout its length in groove 202. Bolt rope tape 203 includes a first portion **203*a* which is stitched to the luff edge of the sail and a second portion 203*b* which carries the bolt rope, the two portions being attached to each other by a slide fastener 205 equipped with an upper runner 206 and a lower runner 207. The combination of tape 203, bolt rope 204 and groove 202 constitutes the first securing means. The second securing means is in the form of a tubular sleeve 208 extending along substantially the entire luff, constructed as described with reference to FIGS. 1–6, and equipped with a slide fastener 209**.

Runner 206 is equipped with an operating line 210 which extends through sleeve 208 upwardly from the runner, over a sheave 211 carried by the head of thee sail, thence downwardly through sleeve 208 on the opposite side of the bolt rope tape to a cleat 212 carried by the foot of the sail, thence upwardly to runner 206. Thus, line 210 can be manipulated to move runner 206 upwardly, to close the slide fastener, and downwardly, to open the slide fastener. Lower runner 207 is similarly equipped with a line 213 which runs upwardly through sleeve 208, over sheave 211, downwardly through the sleeve on the side of the bolt rope tape opposite the runners and to cleat 212, thence upwardly through sleeve 208 to runner 207. Line 213 can be manipulated to move runner 207 upwardly or downwardly, as desired. Provision of lines 210 and 213 allows the portion of the luff of the sail which is attached to stay member 200 to be selected remotely while the sail is aloft. Since sleeve 208 is provided with slide fastener 209, that portion of the luff attached to the stay member can be selected before the sail is raised, then changed by remote manipulations of lines 210, 213.

The Embodiments of FIGS. 17–19

In this embodiment, a bolt rope tape 250 constitutes the first securing means and a sleeve member 251 constitutes the second securing means. Tape 250 is sewn directly to the luff of sail 252, extends for most of the length of the luff, and tapers from a narrower intermediate portion to wider end portions. Tape 250 is provided with a bolt rope 253 which extends for the entire length of the tape. Sleeve member 251 is generally as described with reference to FIGS. 1–6 and is provided with a conventional slide fastener so that the sleeve can be opened, as seen in FIG. 17, and closed around a stay member 254, as in FIGS. 18 and 19.

When the sail is supported by the stay member and flying, so as to be in tension, the narrower intermediate portion of the bolt rope tape 250 is in tension and the sleeve formed by member 251 is in tension throughout its length. However, the wider end portions of tape 250 are completely relaxed and, as seen in FIG. 18, are folded within the sleeve. When the sail is to be reefed, initial rotation of the stay member causes only portion A of tape 250 to commence wrapping on the stay member, and an initial reefing force is thus applied only to that intermediate portion of the luff of sail 252 corresponding to portions A of tape 250. If rotation of the stay member is continued, more and more of the widened end portions of tape 250 are wrapped on the stay member so that the reefing force is applied to a progressively greater portion of the length of the luff of the sail. Since the widened end portions of tape 250 are initially completely relaxed, stay member 254 is initially simply free to rotate within the upper and lower portions of the sleeve formed by member 251. However, as the length of the intermediate portion of tape 250 being wrapped on the stay member increases progressively, more and more of the sleeve formed by member 251 is wrapped on the stay member, just as more and more of the length of tape 250 is brought under tension by the wrapping action. Thus, this embodiment of the invention has the advantage that the progressive reefing action can be predetermined by selection of the shape of the leading edge of tape 250.

In this embodiment, the luff of the sail is cut back over most of its length to provide room for the widened end portions of tape 250. Sleeve member 251 extends beyond both the upper and lower ends of tape 250 and the ends of the sleeve member, and portions of the sail luff adjacent those ends, are provided with lashing grommets 255 so that, after being wrapped around the stay member, the ends of the sleeve can be lashed to the head and foot of the sail. The sleeve member is also sewn to the sail, as at lines 256, to assure that the luff tape carries all luff loads applied to the sail.

What is claimed is:

1. In a marine sail, the combination of a sail body formed of flexible sheet material and having an elongated edge which includes an intermediate portion;

first securing means extending along only said intermediate portion of the elongated edge to attach said intermediate portion to an elongated rotatable support member, said first securing means being dimensioned to be placed substantially under tension when coupled between said intermediate portion of the elongated edge and the rotatable support member; and second securing means secured to said elongated edge and constructed and arranged to surround the elongated support member over at least those portions of the support member to which said first securing means is not effectively attached, and to embrace the elongated support member sufficiently loosely to initially allow free rotation therebetween, said second securing means being so dimensioned that, when the sail is attached to the rotatable support member by said first and second securing means, the rotatable support member is initially free to turn within said second securing means in those locations where the sail is not effectively attached to the support member by said first securing means, initial rotation of the support member then causing only said intermediate portion of the elongated edge of the sail to be rolled upon the support member while the support member turns freely within said second securing means in those locations where the sail is not effectively attached to the support member by said first securing means, continued rotation of the support member then being effective to roll said second securing means and, if desired, the sail body on the support member.

2. The combination defined by claim 1, wherein said second securing means extends along substantially the entire edge of the sail body.

3. In a marine sail, the combination of a sail body formed of flexible sheet material and having an elongated edge which includes an intermediate portion;

first securing means extending along only said intermediate portion of the elongated edge to attach said intermediate portion to an elongated rotatable support member; and second securing means secured to said elongated edge and constructed and arranged to surround the elongated support member over at least those portions of the support member to which said first securing means is not effectively attached, said second securing means being so dimensioned that, when the sail is attached to the rotatable support member by said first and second securing means, the rotatable support member is initially free to turn within said second securing means in those locations where the sail is not effectively attached to the support member by said first securing means, initial rotation of the support member then causing only said intermediate portion of the elongated edge of the sail to be rolled upon the support member while the support member turns freely within said second securing means in those locations where the sail is not effectively attached to the support member by said first securing means, continued rotation of the support member then being effective to roll said second securing means and, if desired, the sail body on the support member, said second securing means extends along only portions of said elongated edge of the sail body not occupied by said first securing means.

4. The combination defined by claim 1, wherein said first securing means extends along only about 30–70% of said elongated edge of the sail body.

5. The combination defined by claim 1, wherein said first securing means comprises a bolt rope tape, the bolt rope of which is adapted to be inserted in a groove of a grooved stay member.

6. The combination defined by claim 5, wherein said bolt rope extends along only said intermediate portion of said elongated edge.

7. In a marine sail, the combination of a sail body formed of flexible sheet material and having an elongated edge which includes an intermediate portion;

first securing means extending along only said intermediate portion of the elongated edge to attach said intermediate portion to an elongated rotatable support member; and second securing means secured to said elongated edge and constructed and arranged to surround the elongated support member over at least those portions of the support member to which said first securing means is not effectively attached, said second securing means being so dimensioned that, when the sail is attached to the rotatable support member by said first and second securing means, the rotatable support member is initially free to turn within said second securing means in those locations where the sail is not effectively attached to the support member by said first securing means, initial rotation of the support member then causing only said intermediate portion of the elongated edge of the sail to be rolled upon the support member while the support member turns freely within said second securing means in those locations where the sail is not effectively attached to the support member by said first securing means, continued rotation of the support member then being effective to roll said second securing means and, if desired, the sail body on the support member, said first securing means comprises a bolt rope tape, the bolt rope of which is adapted to be inserted in a groove of a grooved stay member, said bolt rope extends along only said intermediate portion of said elongated edge, said bolt rope is interrupted so as to comprise bolt rope slugs spaced along said intermediate portion of said elongated edge; and said second securing means comprises a plurality of tabs each adapted to be looped around the rotatable support member and to have its ends secured to the sail.

8. In a marine sail, the combination of a sail body formed of flexible sheet material and having an elongated edge which includes an intermediate portion;

first securing means extending along said intermediate portion of the elongated edge to attach said intermediate portion to an elongated rotatable support member; and second securing means secured to said elongated edge and constructed and arranged to surround the elongated support member over at least those portions of the support member to which said first securing means is not effectively attached, said second securing means being so dimensioned that, when the sail is attached to the rotatable support member by said first and second securing means, the rotatable support member is initially free to turn within said second securing means in those locations where the sail is not effectively attached to the support member by said first securing means, initial rotation of the support member then causing only said intermediate portion of the elongated edge of the sail to be rolled upon the support member while the support member turns freely within said second securing means in those locations where the sail is not effectively attached to the support member by said first securing means, continued rotation of the support member then being effective to roll said second securing means and, if desired, the sail body on the support member, said first securing means comprises a bolt rope tape, the bolt rope of which is adapted to be inserted in a groove of a groove stay member, the bolt rope tape extends for substantially the entire length of the luff edge of the sail body, the width of the bolt rope tape is relatively narrow along said intermediate portion of said elongated edge, and the width of the bolt rope tape is wider where said first securing means is not present.

9. The combination defined by claim 8, wherein the width of the bolt rope tape increases progressively along those portions of said intermediate portion of said elongated edge where said first securing means is not present.

10. In a marine sail, the combination of a said body formed of flexible sheet material and having an elongated edge which includes an intermediate portion;

first securing means extending along only said intermediate portion of the elongated edge to attach said intermediate portion to an elongated rotatable support member; and second securing means secured to said elongated edge and constructed and arranged to surround the elongated support member over at least those portions of the support member to which said first securing means is not effectively attached, said second securing means being so dimensioned that, when the sail is attached to the rotatable support member by said first and second securing means, the rotatable support member is initially free to turn within said second securing means in those locations where the sail is not effectively attached to the support member by said first securing means, initial rotation of the support member then causing only said intermediate portion of the elongated edge of the sail to be rolled upon the support member while the support member turns freely within said second securing means in those locations where the sail is not effectively attached to the support member by said first securing means, continued rotation of the support member then being effective to roll said second securing means and, if desired, the sail body on the support member, said first securing means comprises means for adjusting the length of said intermediate portion of the elongated edge of said sail body which is to be attached to the rotatable support member by said first securing means.

11. The combination defined by claim 10, wherein said first securing means comprises a bolt rope, a bolt rope tape carrying said bolt rope, and an elongated flexible fastener by which the portion of said bolt rope attached to said elongated edge of the sail body can be selected.

12. The combination defined by claim 11, wherein said elongated flexible fastener is a slide fastener equipped with two sliders each moveable from a different end of the fastener to open the fastener progressively.

13. A reefing attachment assembly adapted to be coupled to an elongated edge of a sail, the combination comprising:

a flexible portion adapted to be coupled around at least a portion of an elongated rotatable support member;

connecting means, coupled to said flexible portion, for coupling said flexible portion to the elongated edge of the sail; and securing means, coupled to said flexible portion, for coupling an intermediate portion of the elongated edge of the sail to the rotatable support member, said securing means being dimensioned to be placed substantially under tension when coupled between the intermediate portion of the elongated edge of the sail and the rotatable support member and prior to rotation of the rotatable member for reefing the sail from its fully open position.

14. The reefing attachment assembly according to claim 13, wherein said securing means comprises a bolt rope tape which is adapted to be inserted into a groove formed in the rotatable support member.

15. The reefing attachment assembly according to claim 13, wherein said securing means comprises a bolt rope tape.

16. The reefing attachment assembly according to claim 13, wherein said securing means comprises a flexible tape and a bolt rope.

17. The reefing attachment assembly according to claim 16, wherein said flexible portion includes a longitudinally extending fastener.

18. The reefing attachment assembly according to claim 17, wherein said fastener is a slide fastener.

19. The reefing attachment assembly according to claim 13, wherein the elongated edge of the sail is substantially straight, and said securing means comprises a bolt rope that is substantially parallel to the straight elongated edge of the sail.

20. The reefing attachment assembly according to claim 19, wherein said connecting means comprises stitching along a substantially straight line substantially parallel to said bolt rope.

21. The reefing attachment assembly according to claim 13, wherein said flexible portion is a sleeve.

22. A reefing attachment assembly adapted to be coupled to an elongated edge of a sail, the combination comprising:

a flexible portion adapted to be coupled around at least a portion of an elongated rotatable support member;

connecting means, coupled to said flexible portion, for coupling said flexible portion to the elongated edge of the sail; and securing means, directly coupled to said flexible portion, for coupling an intermediate portion of the elongated edge of the sail to the rotatable support member, said securing means being adapted to be coupled to the rotatable support member, said securing means being a separate element from the sail.

23. The reefing attachment assembly according to claim 22, wherein said securing means comprises a bolt rope tape which is adapted to be inserted into a groove formed in the rotatable support member.

24. The reefing attachment assembly according to claim 22, wherein, said securing means comprises a bolt rope tape.

25. The reefing attachment assembly according to claim 22, wherein said securing means comprises a flexible tape and a bolt rope.

26. The reefing attachment assembly according to claim 25, wherein said flexible portion includes a longitudinally extending fastener.

27. The reefing attachment assembly according to claim 26, wherein said fastener is a slide fastener.

28. The reefing attachment assembly according to claim 22, wherein the elongated edge of the sail is substantially straight, and said securing means comprises a bolt rope that is substantially parallel to the straight elongated edge of the sail.

29. The reefing attachment assembly according to claim 28, wherein said connecting means comprises stitching along a substantially straight line substantially parallel to said bolt rope.

30. The reefing attachment assembly according to claim 22, wherein said flexible portion is a sleeve.

31. A reefing attachment assembly adapted to be coupled to an elongated edge of a sail, the combination comprising:

a flexible portion adapted to be coupled around at least a portion of an elongated rotatable support member and being dimensioned to embrace the rotatable support member sufficiently loosely to initially allow free rotation therebetween;

connecting means, coupled to said flexible portion, for coupling said flexible portion to the elongated edge of the sail; and securing means, directly coupled to said flexible portion, for coupling an intermediate portion of the elongated edge of the sail to the rotatable support member, said securing means being adapted to be coupled to the rotatable support member, said securing means being a separate element from the sail.

32. In a marine sail, the combination of a sail body formed of flexible sheet material and having an elongated edge which includes an intermediate portion;

first securing means extending along only said intermediate portion of the elongated edge to attach said intermediate portion to an elongated rotatable support member; and second securing means secured to said elongated edge and constructed and arranged to surround the elongated support member over at least those portions of the support member to which said first securing means is not effectively attached, and to embrace the elongated support member sufficiently loosely to initially allow free rotation therebetween, said second securing means being so dimensioned that, when the sail is attached to the rotatable support member by said first and second securing means, the rotatable support member is initially free to turn within said second securing means in those locations where the sail is not effectively attached to the support member by said first securing means, initial rotation of the support member then causing only said intermediate portion of the elongated edge of the sail to be rolled upon the support member while the support member turns freely within said second securing means in those locations where the sail is not effectively attached to the support member by said first securing means, continued rotation of the support member then being effective to roll said second securing means and, if desired, the sail body on the support member.

33. In a marine sail, the combination of a sail body formed of flexible sheet material and having an elongated edge which includes an intermediate portion;

first securing means extending along only said intermediate portion of the elongated edge to attach said intermediate portion to an elongated rotatable support member, said first securing means being dimensioned to be placed substantially under tension when coupled between said intermediate portion of the elongated edge and the rotatable support member; and second securing means secured to said elongated edge and constructed and arranged to surround the elongated support member over at least those portions of the support member to which said first securing means is not effectively attached, said second securing means being so dimensioned that, when the sail is attached to the rotatable support member by said first and second securing means, the rotatable support member is initially free to turn within said second securing means in those locations where the sail is not effectively attached to the support member by said first securing means, initial rotation of the support member then causing only said intermediate portion of the elongated edge of the sail to be rolled upon the support member while the support member turns freely within said second securing means in those locations where the sail is not effectively attached to the support member by said first securing means, continued rotation of the support member then being effective to roll said second securing means and, if desired, the sail body on the support member.

* * * * *